United States Patent [19]

Plasko

[11] 4,001,754

[45] Jan. 4, 1977

[54] TEMPERATURE RESPONSIVE ELECTRICAL SWITCH CONSTRUCTION AND METHOD OF MAKING THE SAME

[75] Inventor: Emil Robert Plasko, Washington Township, Ohio

[73] Assignee: Emerson Electric Co., St. Louis, Mo.

[22] Filed: May 21, 1974

[21] Appl. No.: 471,851

[52] U.S. Cl. ..... 337/407; 337/403

[51] Int. Cl.[2] ..... H01H 37/36

[58] Field of Search ..... 337/407, 408, 409, 403

[56] References Cited

UNITED STATES PATENTS 3,519,972 7/1970 Merrill ..... 337/407

*Primary Examiner*—Harold Broome

*Attorney, Agent, or Firm*—Candor, Candor & Tassone

[57] ABSTRACT

A collapsible pellet thermal limiter construction having an electrical switching unit that changes its condition when the pellet melts by being heated to a certain temperature for the particular pellet and having an epoxy material sealing one end of the casing of the construction. A filler material is disposed in the epoxy material and is in the order of approximately 4% to approximately 6% by weight of the epoxy material when the pellet has a particular melting temperature other than approximately 208° F., 244° F., 298° F. or 358° F.

9 Claims, 6 Drawing Figures

TEMPERATURE RESPONSIVE ELECTRICAL SWITCH CONSTRUCTION AND METHOD OF MAKING THE SAME

This invention relates to an improved temperature responsive electrical switch construction and to a method of making the same or the like.

It is well known from the U.S. patents to Merrill, U.S. Pat. Nos. 3,180,958 and 3,519,972, that a temperature responsive electrical switch construction can be provided wherein the same is a collapsible pellet type and has an electrical switching means that changes its operating condition when the pellet melts by being heated to a certain temperature for the particular pellet. The casing of such a switch construction has a ceramic end plug closing one end thereof and is sealed closed by an epoxy material covering a projecting part of the end plug, the adjacent casing structure and a projecting lead to prevent the external atmosphere from reaching the pellet that is disposed inside the casing and causing deterioration or malfunction thereof.

In the past, such temperature responsive electrical switch constructions were manufactured with the pellet material thereof being adapted to melt at different predetermined temperatures so that the consumer could select the particular temperature rated thermal limiter construction that would open a desired electrical circuit when a particular temperature was reached, such as 208° F., 218° F., 244° F., etc.

The manufacturer of such temperature responsive electrical switch constructions found that in order to readily identify the particular temperature that a particular temperature response electrical switch construction was to open it would be best to utilize a color coding system wherein metallic oxide pigments were mixed in the epoxy material so that different colors of epoxy material would designate different temperature ratings of the particular electrical switch constructions. For example, a red colored epoxy material would designate that its temperature responsive switch construction would open or blow when it sensed a temperature of approximately 208° F. whereas a blue epoxy material would indicate a 218° F. operation.

Such color coded temperature responsive electrical switch constructions have been sold more than one year before the filing date of this patent application and have provided an excellent temperature rating identification system.

However, subsequently, it was determined that certain thermal limiter constructions of the above type would fail over a particular life span thereof due to leakage of external air through the epoxy seal to the internal pellet thereof to cause the same to deteriorate and/or malfunction so that the particular thermal responsive electrical switch construction might blow at a sensed temperature below the desired temperature rating thereof or may not blow until a temperature higher than the particular desired temperature rating thereof is sensed.

According to the teachings of this invention, however, it is believed that the effective seal life of the epoxy material can be substantially extended to prevent such aforementioned deterioration and/or malfunction of the pellet material of such thermal limiter construction if a certain percentage by weight of a filler material is contained in the epoxy material forming the seal therefor.

It was determined according to the teachings of this invention that such filler material should be approximately 4% to approximately 6% by weight of the epoxy material for each thermal limiter construction and that such filler material could be metallic oxide pigment material, such as the pigment material originally utilized for color coding purposes as previously described.

Thus, a review of the past activity of the manufacturer of color coded thermal limiter constructions was made and it was found that through happenstance, certain temperature rated thermal limiter constructions were sold more than a year before the filing date of this patent application having epoxy seals that contained metallic oxide pigments therein of a percentage of weight that fell within the critical 4%-6% range that was found according to the teachings of this invention to render the epoxy material with improved characteristics for sealing the thermal limiter constructions as set forth above.

In particular, it was found that thermal limiter constructions were sold more than a year before the filing date of this patent application that contained between 4% to 6% metallic oxide pigment by weight in the epoxy seal material thereof solely for color coded purposes and such thermal limiter constructions that were sold only had the pellet material thereof melt when the same reached approximately 208° F., 218° F., 244° F., 298° F. or 358° F., as all other color coded thermal limiter constructions that operated at other temperatures had substantially less metallic oxide therein, such as 1% by weight and the like.

As previously stated, since the aforementioned five temperature rated thermal limiter constructions had the amount of color material in the epoxy seal thereof selected solely for the purpose of providing sufficient color appearance solely for the purpose of color coding and not for the purpose of improving the characteristics of the epoxy seal material, applicant is seeking patent protection for the use of the filler material in the critical percentage range of weight thereof as previously set forth for all such thermal limiter constructions that have temperature ratings other than the particular temperature ratings that through happenstance contain the critical range of filler material solely for color coding purposes thereof as sales of such thermal limiter constructions took place more than one year before the filing date of this patent application. This determination is being made on the basis that such sales of such prior color coded thermal limiter constructions would constitute a statutory bar to claims that would encompass such thermal limiter constructions whereas since such prior color coded thermal limiter constructions did not teach that a certain percentage by weight of filler material should be utilized in the seal material of all temperature rated thermal limiter constructions, then patent protection can be provided for this new and unexpected teaching of this invention.

Therefore, it is a feature of this invention to provide an improved limiter construction of the above type wherein approximately 4% to approximately 6% filler material by weight is disposed in the epoxy material forming the seal thereof where the particular epoxy material of the thermal limiter construction is selected to melt at temperatures other than approximately 208° F., 218° F., 244° F., 298° F. and 358° F.

It is another feature of this invention to provide a thermal limiter construction of the above type wherein a filler material is disposed in the epoxy material seal thereof and is approximately 4% to approximately 6% by weight of the epoxy material when the pellet material of the thermal limiter construction is set to melt at approximately 370° F. or higher.

Another feature of this invention is to provide such a thermal limiter construction wherein the filler material in the epoxy material seal thereof is approximately 4% to approximately 6% by weight of the epoxy material when the particular pellet material thereof is set to melt at approximately 200° F. or lower.

Another feature of this invention is to provide an improved method of making the thermal limiter constructions of this invention.

In particular, one embodiment of this invention provides a collapsible thermal limiter construction having electrical switching means that changes its condition when the pellet melts by being heated to a certain temperature for the particular pellet and having an epoxy material sealing one end of the casing of the construction. Filler material is substantially uniformly disposed in the epoxy material in the order of approximately 4% to approximately 6% by weight of the epoxy material whereby the filler material improves the effective seal life of the epoxy material, the pellet of the thermal limiter construction having a particular melting temperature other than approximately 208° F., 218° F., 244° F., 298° F. or 358° F.

Accordingly, it is an object of this invention to provide an improved thermal limiter construction having one or more of the novel features set forth above or hereinafter shown or described.

Another object of this invention is to provide an improved method for making such a thermal limiter construction or the like.

Other objects, uses and advantages of this invention are apparent from a reading of this description which proceeds with reference to the accompanying drawings forming a part thereof and wherein.

Figure 1:
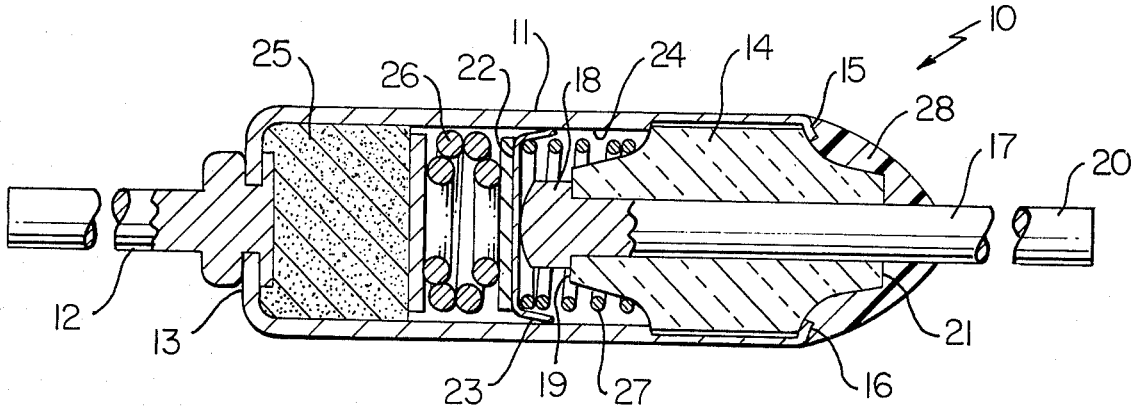
FIG. 1 is an enlarged cross-sectional view of the improved thermal limiter construction of this invention.

While the various features of this invention are hereinafter described and illustrated as being particularly adapted to provide an epoxy seal for a particularly constructed thermal limiter construction, it is to be understood that the various features of this invention can be utilized singly or in any combination thereof to provide an epoxy seal for other types of thermal limiter constructions as desired.

Therefore, this invention is not to be limited to only the embodiment illustrated in the drawings, because the drawings are merely utilized to illustrate one of the wide variety of uses of this invention.

Figure 2:
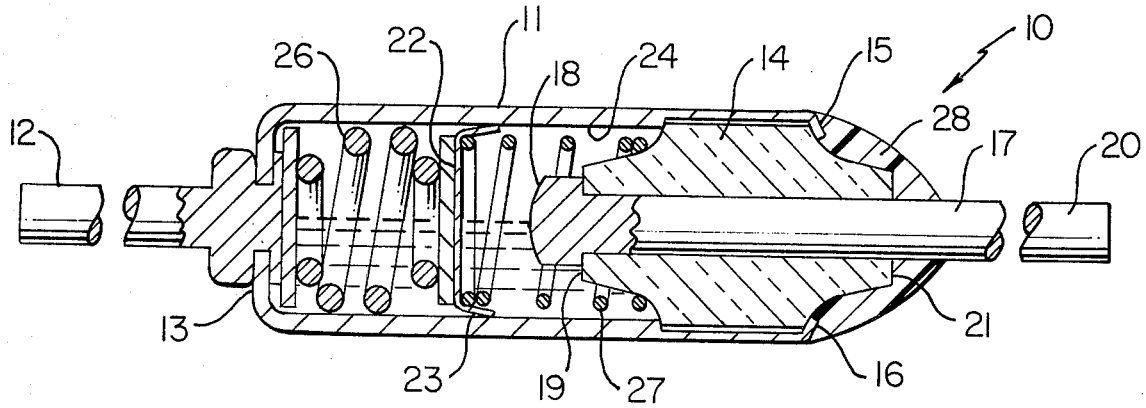
FIG. 2 is a view similar to FIG. 1 and illustrates the thermal limiter construction after the pellet material has melted to cause the switch means thereof to change its operative condition.
Figure 6:
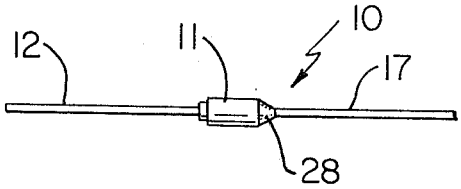
FIG. 6 is an elevation view of the thermal limiter construction of FIG. 1, but in reduced size, illustrating approximately the actual size of the thermal limiter construction of this invention.

Referring now to FIGS. 1, 2 and 6, the improved thermal limiter construction of this invention is generally indicated by the reference numeral 10 and is substantially identical to the thermal limiter construction disclosed and claimed in the aforementioned U.S. patent to Merrill, U.S. Pat. No. 3,519,972, as well as the other Merrill U.S. Pat. No. 3,180,958, whereby such patents are incorporated in this disclosure by reference thereto as any information desired as to the particular construction and operation of the thermal limiter construction 10 can be obtained from such patents.

Therefore, it is believed only necessary to describe the thermal limiter construction 10 in a general manner hereinafter in order to understand the improved features of this invention.

Figure 5:
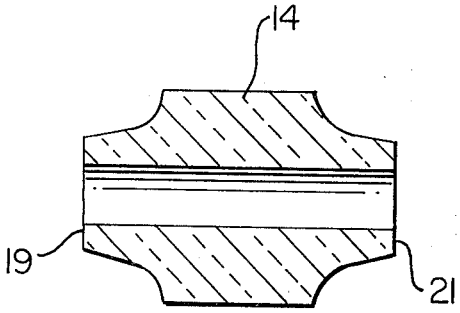
FIG. 5 is a cross-sectional view of the ceramic end plug of the switch construction of FIG. 1.

In particular, the thermal limiter construction 10 includes a conductive casing 11 having a conductor 12 secured in electrical contact with a closed end 13 of the casing 11. A ceramic end plug 14, as best illustrated in FIG. 5, is disposed in an open end 15 of the casing 11 and is secured thereto by a turned over portion 16 of the end 15 of the casing 11 as illustrated in FIG. 1, a second electrical conductor 17 passing through the bushing 14 and having an enlarged head 18 disposed against one end 19 of the end plug 14 and another end 20 projecting out of the other end 21 of the end plug 14 for external lead attachment purposes.

Figure 3:
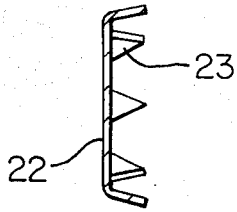
FIG. 3 is a side view of a sliding contact member of the switch construction of FIG. 1.
Figure 4:
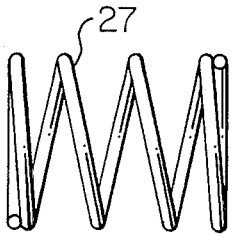
FIG. 4 is a side view of a spring of the switch construction of FIG. 1.

A sliding conductive contact member 22, as best illustrated in FIG. 3, is disposed inside the casing 11 and has resilient peripheral fingers 23 disposed in sliding engagement with the internal peripheral surface 24 of the casing 11 to provide electrical contact therebetween.

A thermally responsive pellet 25, of the type set forth in the aforementioned patents to Merrill or formed of other suitable material, is disposed in the casing 11 against the end wall 13 thereof and a pair of compression springs 26 and 27 are respectively disposed on opposite sides of the sliding contact member 22 such that the compression spring 26 is in a compressed condition between the solid pellet 25 and the contact member 22 and is stronger than the force of the compressed spring 27 which is disposed between the contact member 22 and the end plug 14 whereby the contact member 22 is held by the force of the spring 26 in electrical contact with the enlarged end 18 of the conductor 17 so that an electrical circuit is provided between the conductors 12 and 17 through the casing 11 and sliding contact member 22 of the thermal limiter construction 10 as illustrated in FIG. 1.

However, when the particular temperature for melting the pellet 25 is reached, the pellet 24 melts in the manner illustrated in FIG. 2 whereby the springs 26 and 27 are adapted to expand and thereby through the relationship of the particular forces of the springs 26 and 27, the sliding contact member 22 is moved out of electrical contact with the end 18 of the second conductor 17 in the manner illustrated in FIG. 2 so that the electrical circuit between the conductors 12 and 17 through the thermal limiter construction 10 is broken and remains open as illustrated in FIG. 2 until the blown thermal limiter construction 10 is replaced.

As previously stated, in order to seal the end plug 14 to the casing 11 so that external air cannot reach the interior of the casing 11 and attack or otherwise cause malfunctioning of the pellet material 25, an epoxy seal material 28 is disposed on the end 21 of the end plug 14 as illustrated in FIGS. 1 and 2 to cover not only the end 21 of the end plug 14, but also at least the part 16 of the casing 11 as well as a certain length of the end 20 of the conductor 17 adjacent the end plug 14 so that all areas leading to the interior of the casing 11 through the open end 15 of the casing 11 to the interior thereof are sealed by the epoxy material 28.

Additionally, the epoxy seal 28 is utilized to insure that the external air gap from the exposed part of the casing 11 at the end 15 thereof to the closest adjacent exposed part of the end 20 of the conductor 17 is at least of a certain length to thereby prevent arcing between such casing 11 and the exposed part 20 of the conductor 17 and thereby a bypassing of the sliding contact 22.

As previously stated, it was found that when the epoxy material 28 was utilized for such a thermal limiter construction 10 wherein the pellet material 25 was selected to cause the thermal limiter construction 10 to open or change its switching function in a manner illustrated in FIG. 2 when the pellet material 25 was heated at a temperature above 400° F., the shelf life of such thermal limiter constructions 10 varied because the pellet material 25 tended to deteriorate and/or malfunction through what is believed to be air leakage through the seal 28 because the seal 28 before hardening thereof tended to bleed by capillary attraction into the space between the end plug 14 and casing 11 and/or between the conductor 17 and the end plug 14 and thereby reduce the amount of epoxy material 28 in certain areas so that the same subsequently failed and permitted air to leak therethrough into the interior of the casing 11.

According to the teachings of this invention, it was found that if filler material was initially substantially uniformly disposed in the epoxy material 28 and such filler material was approximately 4% to approximately 6% by weight of the epoxy material 28, the resulting epoxy material seal 28 did not tend to bleed away from the desired seal areas through improved characteristics of the seal material 28 so that the same did not fail and thereby prevented air from leaking to the pellet material 25.

In particular, the epoxy material 28 comprised an epoxide resin, such as Eccoseal W19 and Eccoseal W-66 sold by Emerson and Cuming, Inc. of Canton, Massachusetts. The filler material utilized according to the teachings of this invention comprises a metallic oxide pigment sold by the Ferro Corporation of Orrvill, Ohio, and such pigment in various colors thereof are designated as dark red V-8840 pigment, light red V-8820 pigment, black V-302 pigment, green V-7687 pigment, yellow V-9810 pigment, blue V-3285 pigment, white F-5073 pigment and brown V-5102 pigment.

As previously stated, it was found that when such filler material was approximately 4% to approximately 6% by weight of the aforementioned epoxy material 28 and was initially substantially uniformly mixed with the epoxy material 28 before being disposed on the thermal limiter construction 10, the same improved the epoxy seal 28 for the thermal limiter construction 10 where the thermal limiter construction 10 had a casing length of approximately 0.457 of an inch between the exposed parts of the conductors 12 and 17 and a casing outside diameter of approximately 0.157 of an inch.

Accordingly, it can be seen that this invention not only provides an improved thermal limiter construction, but also this invention provides an improved method of making such a thermal limiter construction or the like.

While the form and method of this invention now preferred have been described and illustrated as required by the Patent Statute, it is to be understood that other forms and method steps can be utilized and still come within the scope of the appended claims.

What is claimed is:

1. In a method of making a line of collapsible pellet thermal limiter constructions each having electrical switching means that changes its condition when its respective pellet melts by being heated to a certain temperature for the particular pellet and having an epoxy material sealing one end of a casing of said construction, said line of thermal limiter constructions including constructions that will have their respective pellets melt at temperatures at or below approximately 200° F and at or above approximately 370° F, the improvement comprising the step of disposing filler material in said epoxy material of each thermal limiter construction being made in said line only in the order of approximately 4% to approximately 6% by weight of said epoxy material whereby said filler material improves the effective seal life of said epoxy material of each thermal limiter construction being made in said line thereof.

2. In a method of making a line of collapsible pellet thermal limiter constructions as set forth in claim 1, said step of disposing comprising the step of initially disposing said filler material substantially uniformly throughout said epoxy material.

3. In a method of making a line of collapsible pellet thermal limiter constructions as set forth in claim 1, the additional step of forming said filler material from metallic oxide pigment.

4. In a method of making a line of collapsible pellet thermal limiter constructions each having electrical switching means that changes its condition when said pellet melts by being heated to a certain temperature for the particular pellet and having an epoxy material sealing one end of a casing of said construction, said line of thermal limiter constructions including constructions that will have their respective pellets melt at temperatures of approximately 370° F or higher, the improvement comprising the step of disposing filler material in said epoxy material of each thermal limiter construction being made in said line only in the order of approximately 4% to approximately 6% by weight of said epoxy material whereby said filler material improves the effective seal life of said epoxy material of each thermal limiter construction being made in said line thereof.

5. In a method of making a line of collapsible pellet thermal limiter constructions as set forth in claim 4, said step of disposing comprising the step of initially disposing said filler material substantially uniformly throughout said epoxy material.

6. In a method of making a line of collapsible pellet thermal limiter constructions as set forth in claim 4, the additional step of forming said filler material from metallic oxide pigment.

7. In a method of making a line of collapsible pellet thermal limiter constructions each having electrical switching means that changes its condition when said pellet melts by being heated to a certain temperature for the particular pellet and having an epoxy material sealing one end of a casing of said construction, said line of thermal limiter constructions including constructions that will have their respective pellets melt at temperatures of approximately 200° F or lower, the improvement comprising the step of disposing filler material in said epoxy material of each thermal limiter construction being made in said line only in the order of approximately 4% to approximately 6% by weight of said epoxy material whereby said filler material improves the effective seal life of said epoxy material of each thermal limiter construction being made in said line thereof.

8. In a method of making a line of collapsible pellet thermal limiter constructions as set forth in claim 7, said step of disposing comprising the step of initially disposing said filler material substantially uniformly throughout said epoxy material.

9. In a method of making a line of collapsible pellet thermal limiter constructions as set forth in claim 7, the additional step of forming said filler material from metallic oxide pigment.

* * * * *